US007073612B2

(12) United States Patent
Finchum

(10) Patent No.: US 7,073,612 B2
(45) Date of Patent: Jul. 11, 2006

(54) SURGE DEVICE FOR AIR DRILLING

(76) Inventor: Ray A. Finchum, Rt 1, Box 910, Cameron, OK (US) 74932

( * ) Notice: Subject to any disclaimer, the term of this patent is extended or adjusted under 35 U.S.C. 154(b) by 226 days.

(21) Appl. No.: 10/858,259

(22) Filed: Jun. 1, 2004

(65) Prior Publication Data

US 2005/0263326 A1 Dec. 1, 2005

(51) Int. Cl.
*E21B 21/16* (2006.01)

(52) U.S. Cl. ..... 175/211; 175/213

(58) Field of Classification Search ..... 175/210–213, 175/205, 209

See application file for complete search history.

(56) References Cited

U.S. PATENT DOCUMENTS 1,334,430 A * 3/1920 Ayotte ..... 175/209
1,981,570 A * 11/1934 Price ..... 175/211
1,985,157 A * 12/1934 Friedman et al. ..... 15/409
2,041,689 A * 5/1936 Baumeister et al. ..... 175/135
2,712,921 A * 7/1955 Redman ..... 175/210
2,715,016 A * 8/1955 Veneziani et al. ..... 175/195
4,434,861 A * 3/1984 Howeth ..... 175/66
4,539,105 A 9/1985 Metcalf
4,811,799 A 3/1989 Blackwell et al.
5,096,691 A 3/1992 Bedell
5,975,219 A 11/1999 Sprehe
6,162,284 A 12/2000 Mitchell et al.
6,422,608 B1 7/2002 Lee et al.
6,494,234 B1 12/2002 Esser

* cited by examiner

*Primary Examiner*—Kenneth Thompson
(74) *Attorney, Agent, or Firm*—Molly D. McKay

(57) ABSTRACT

A surge device providing a vent for bleeding pressure off an air drilled well and providing connectors for surge lines in the blooie line. The surge device has a hollow, abrasion resistant, tapered chamber into which two surge lines and the blow down line enter the surge device. The device is provided with a flange at each end of the chamber for attaching the device into a blooie line with the narrow end of the tapered chamber attached to the downstream end of the blooie line and an enlarged end of the tapered chamber attached to the upsteam end of the blooie line. An abrasion resistant shield pipe penetrating the enlarged end of the tapered chamber and extending into the tapered chamber a sufficient distance to serve as a shield for the terminal ends of the surge lines and the blow down line.

8 Claims, 4 Drawing Sheets

SURGE DEVICE FOR AIR DRILLING

BACKGROUND OF THE INVENTION

1. Field of the Invention

The present invention relates to a surge device for use with equipment used in air drilling a well. More specifically, the present invention is a surge device that inserts in the flow or blooie line and contains connectors for attaching two surge lines and contains a blowdown or vent line for bleeding off pressure from the well bore.

2. Description of the Related Art

During air drilling of a well, the workmen will need to break the string of drill pipe frequently to make up new connections in the drill string. Before workman can safely break the string, they must first insure that pressure has been bled off of the drill pipe so that the pressure will not blow out at them as they break the string. Also before they can safely break the string, they must insure that flammable gas is constantly removed from the well while they are making the connection so that flammable gas from the well does not flow onto the drilling platform and cause an explosion or fire as they break the string and make the connection. Currently, a blow down line and surge lines are installed in the blooie line to insure, respectively, that pressure is bled off of the drill pipe prior to the workmen breaking the pipe and that flammable gas from the well is constantly pulled out of the well via the blooie line as the workmen break the string and make the connection.

The current method of installing these surge lines and the blow down line in the blooie line is to cut at an angle one end on each of three pipes and then weld the angled cut end of each of the three pipes to openings previously cut into the side of the blooie line. When thus attached to the blooie line, one of the pipes serves as the blow down or vent line and the other two pipes serve as surge lines.

The problem with the current method of installing these pipes to the blooie line is that due to the highly abrasive nature of the material that is passing through the blooie line, the three pipes and their connection to the blooie line do not hold up well and are often the point at which abrasion causes a failure in the blooie line. This can result in downtime to fix the leak and can result leakage of flammable gas that can explode or catch on fire.

Another problem with the current method of installing the two pipes to the blooie line that will serve as the surge lines is that the openings in the blooie line to which the angled ends of the pipes are welded is an elongated oval shape. This elongated oval shape orifice does not function well to direct air in a downstream orientation within the blooie line as the air flows into the blooie line from the surge lines. It is important that the air that enters the blooie line from the surge lines is directed in a downstream orientation because when the air is thus directed, a vacuum is created in the upstream or well end of the blooie line. This vacuum is the means for removing flammable gas from the well when the workmen are breaking pipe to make up a connection in the drill string. If the surge lines are not effective in pulling a vacuum on the well, flammable gas originating in the well could travel upward through the wellhead where it could explode or ignite, resulting in disastrous injury to workmen and damage to the drilling rig.

The present invention addresses these problems by providing a surge device that is provided with flanges that allow it to be removably installed in-line on the blooie line so that if there is a failure with either the surge lines or with the blow down line, the surge device can be unbolted from the blooie line and replaced in its entirety. The ability to replace the surge device eliminates the need for special on-site pipe cutting and welding on the blooie line in the event of failure on the surge lines or blow down line and greatly reduces down time that would normally occur with the present method of installing the surge lines and blow down line directly into the blooie line.

Also, the present surge device provides for better and more reliable orientation of the surge lines relative to the blooie line, thereby insuring that the surge lines are effective in pulling a vacuum on the well sufficient to safely remove flammable gases from the well via the blooie line. Further, the present invention is provided with a reduction in the exit diameter of the surge lines where they terminate within the surge device, thereby insuring high velocity of air flowing from the surge lines into the blooie line.

Finally, the present invention is provided with a shield pipe internally that shields the surge lines and blow down line from abrasion by the materials that flow through the blooie line, thereby resulting in less chance of failure at these locations. Internal surfaces of the present invention are constructed with abrasion resistant plate to extend the useful life of the invention.

SUMMARY OF THE INVENTION

The present invention is a surge device for use with drilling equipment used in air drilling a well. The surge device inserts in the flow or blooie line and contains connectors for attaching two surge lines and contains a blowdown or vent line for bleeding off pressure from the well bore. The surge device is provided with a tapered chamber into which the two surge lines and the blow down line enter the surge device. This tapered chamber is hollow and is provided with a flange at each end of the chamber. The chamber is provided with a first flange on a narrow end of the tapered chamber that can be removably bolted to a flange provided on the blooie line so that the tapered end of the tapered chamber attaches to the downstream end of the blooie line. The downstream end of the blooie line, in turn, connects to the reserve pit. Normally either a flare or pilot light is provided at the reserve pit to safely burn any entrained flammable gases that flow to the reserve pit via the blooie line.

The chamber is also provided with a second flange on an opposed, enlarged end of the tapered chamber that can be removably bolted to a flange provided on the blooie line so that the enlarged end of the tapered chamber attaches to the upsteam or well end of the blooie line. The upstream end of the blooie line connects to the well casing via the rotating head. Thus the chamber of the surge device is in communication with the annulus of the well and can, via the blow down line that is provided on the surge device, be used to bleed pressure off of the well prior to breaking pipe to make a connection, and can, via the surge lines provided on the surge device, be used to pull a vacuum on the well to remove flammable gases from the well when workmen are engaged in making up a connection.

The second flange is attached to a shield pipe that penetrates the enlarged end of the tapered chamber and extends into the tapered chamber a sufficient distance to serve as a shield for the terminal ends of the surge lines which penetrate through and extend into the tapered chamber at the enlarged end and for the blow down line that attaches to the tapered chamber at the enlarged end. Abrasive material and any entrained flammable gases that originate in the well pass through the surge device by first entering the second flange, then traveling through the shield pipe attached to the second flange until the shield pipe ends within the tapered chamber, traveling through the tapered chamber to its narrow end, and then traveling out of the surge device via the first flange to enter the downstream end of the blooie line which carries the abrasive material and entrained gases to the reserve pit.

DETAILED DESCRIPTION OF THE PREFERRED EMBODIMENT THE INVENTION

Figure 1:
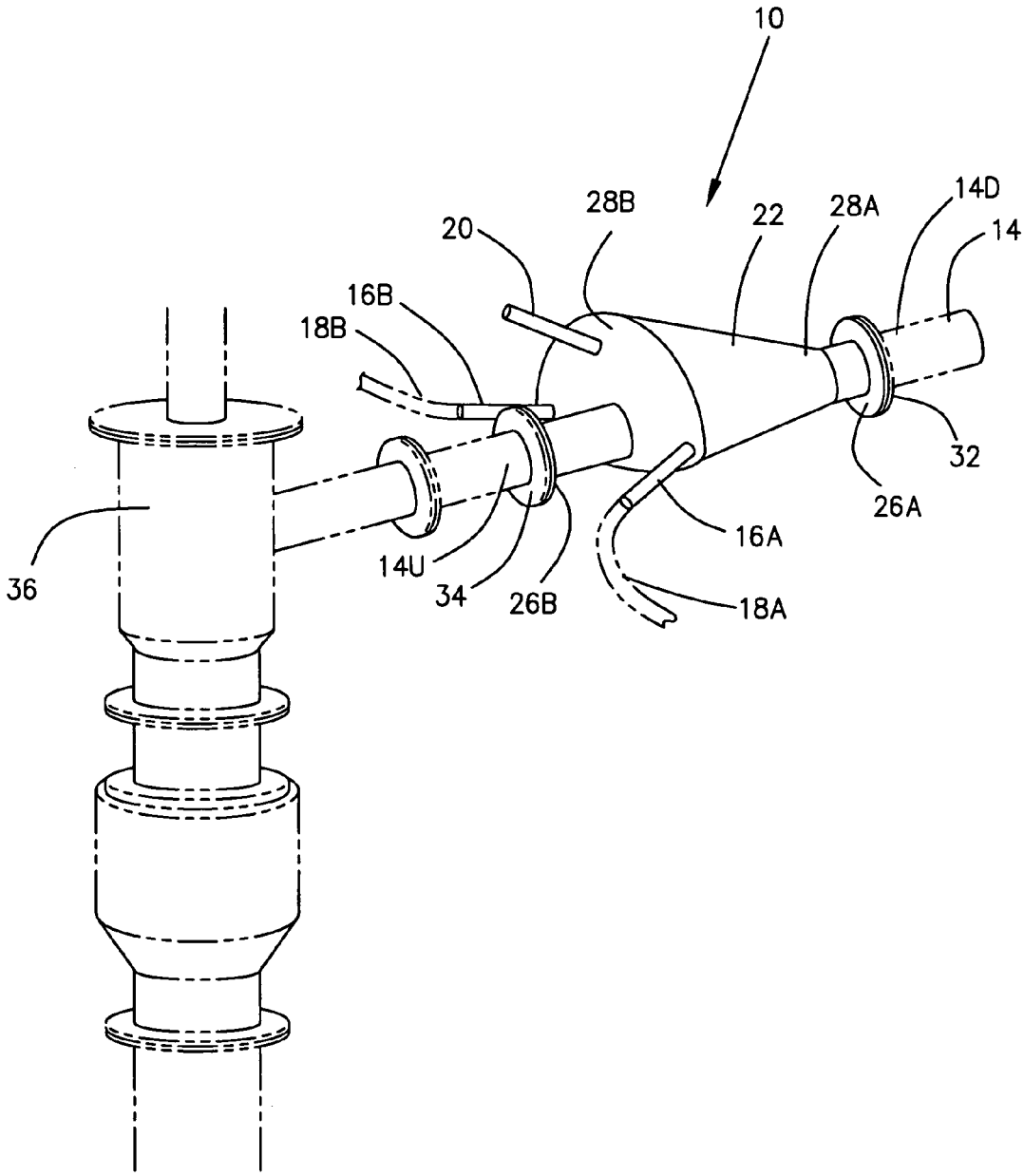
FIG. 1 is a perspective view of a surge device constructed in accordance with a preferred embodiment of the present invention shown in use in a blooie line of a well head.
Figure 2:
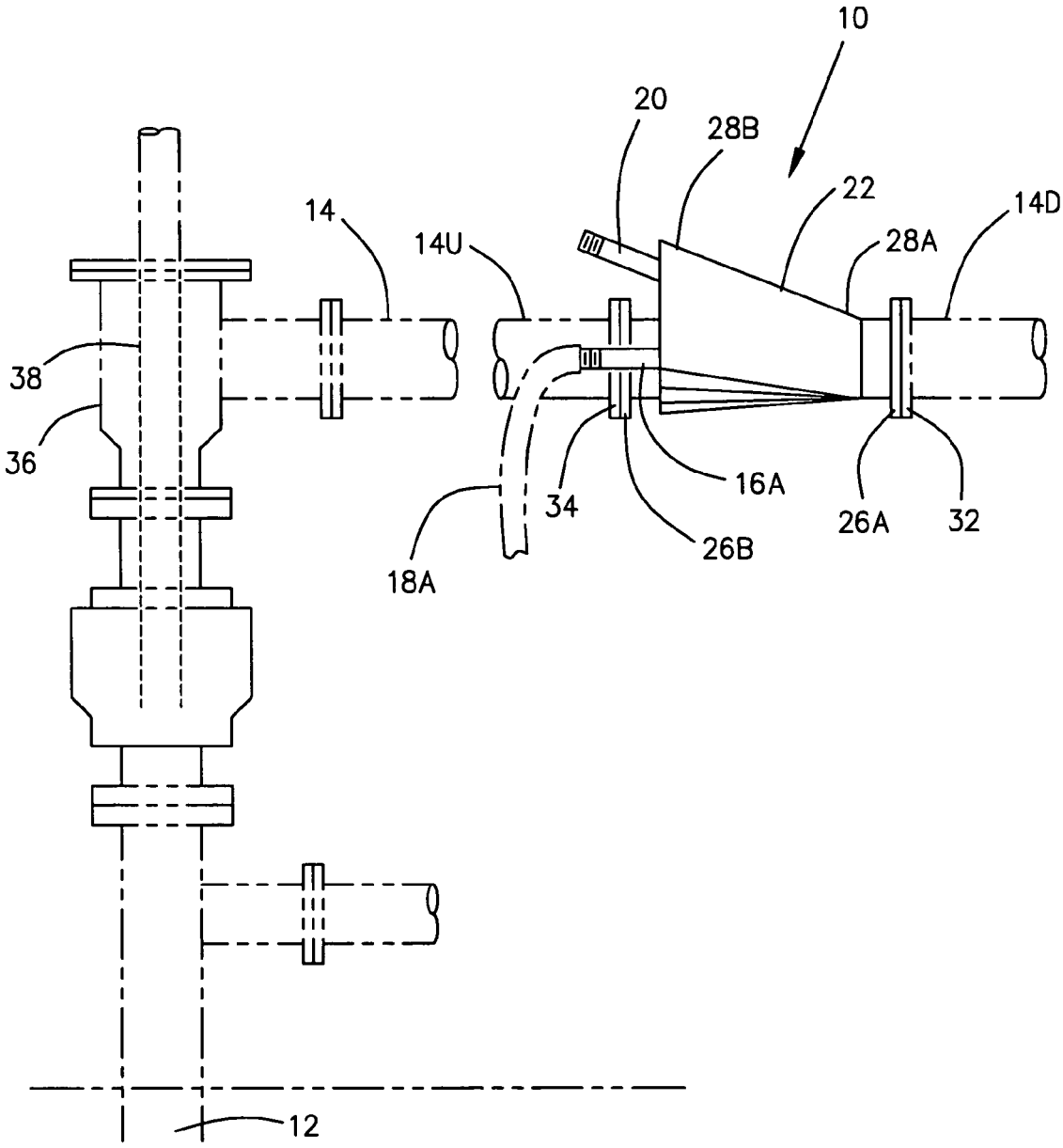
FIG. 2 is a side view of the surge device of FIG. 1, showing the device installed in the blooie line of the well head.
Figure 3:
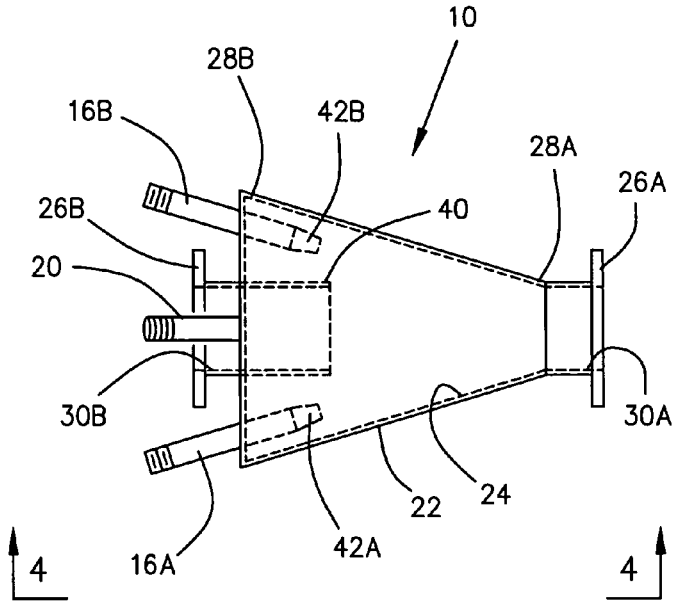
FIG. 3 is a top plan view of the surge device of FIG. 2 shown removed from the blooie line.
Figure 5:
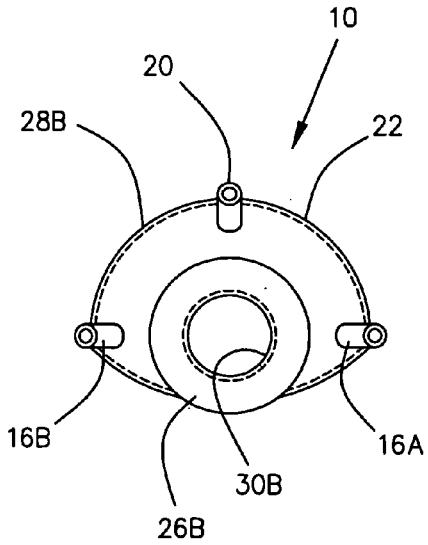
FIG. 5 is a front end view of the surge device taken along line 5—5 of FIG. 4.
Figure 4:
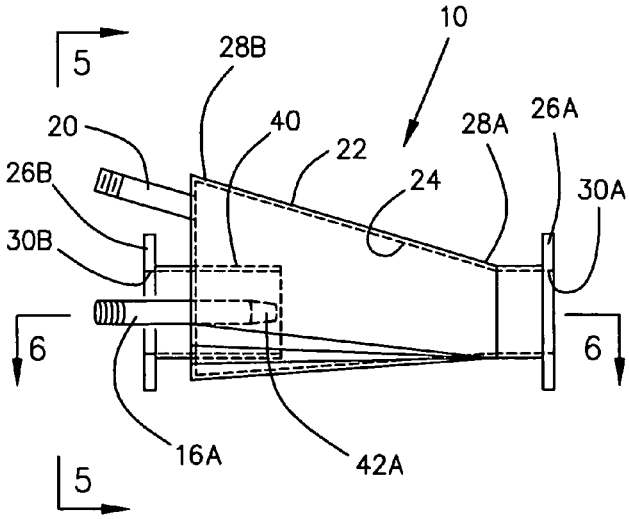
FIG. 4 is a side view of the surge device taken along line 4—4 of FIG. 3.
Figure 6:
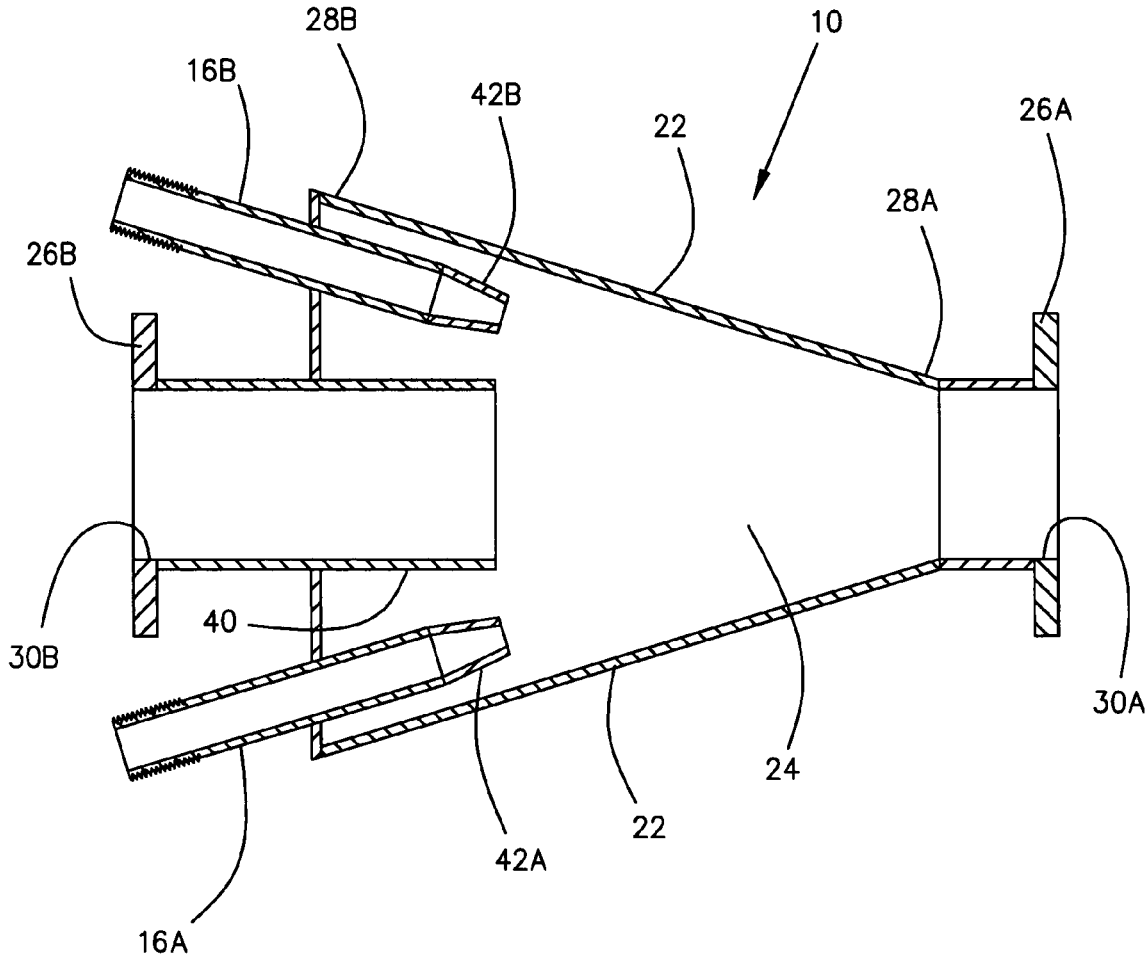
FIG. 6 is a cross sectional view of the surge device taken along line 6—6 of FIG. 4.

Referring now to the drawings, and initially to FIGS. 1 and 2, there is illustrated a surge device 10 constructed in accordance with a preferred embodiment of the present invention. FIGS. 1 and 2 show the surge device 10 in use with drilling equipment, shown in outline, that is used in air drilling a well 12. The surge device 10 is installed in a flow or blooie line 14 and it contains connectors 16A and 16B for attaching the two surge lines 18A and 18B to the surge device 10 and also contains a blowdown or vent line 20 for bleeding off pressure from the well 12. The surge lines 18A and 18B are also called air vacuum lines because they supply air to the blooie line 14 which in turn creates a vacuum on the well 12. The surge device 10 is provided with walls 22 that form an internal, hollow tapered chamber 24 into which the connectors 16A and 16B for the two surge lines 18A and 18B and the blow down line 20 enter the surge device 10.

The surge device 10 is provided with a flange 26A and 26B located at each end 28A and 28B, respectively, of the chamber 24. Both flanges 26A and 26B attach to the walls 22 so that the flange openings 30A and 30B provided in the flanges 26A and 26B, respectively, communicate with the tapered chamber 24. A first flange 26A is preferably removably bolted on a narrow end 28A of the tapered chamber 24 to a flange 32 provided on the blooie line 14 so that the narrow end 28A of the tapered chamber 24 attaches to a downstream end 14D of the blooie line 14. Although not illustrated, the downstream end 14D of the blooie line 14, in turn, connects to a reserve pit for the well 12. Normally either a flare or pilot light is provided at the reserve pit to safely burn any entrained flammable gases that flow to the reserve pit via the blooie line 14.

The device 10 is also provided with a second flange 26B on an opposite, enlarged end 28B of the tapered chamber 24 that can be removably bolted to a flange 34 provided on the blooie line 14 so that the enlarged end 28B of the tapered chamber 24 attaches to an upsteam or well end 14U of the blooie line 14.

Referring to FIGS. 3–6, the connectors 16A and 16B are provided at the enlarged end 28B of the chamber 24 on either side of the shield pipe 40 and are preferably located 180 degrees from each other. The connectors 16A and 16B enter the chamber 24 at the proper angle so that they point toward the first flange 26A and toward the downstream end 14D of the blooie line 14 via flange opening 30A. Also, the proximal terminal ends 42A and 42B of the connectors 16A and 16B are preferably narrowed in diameter so that they are somewhat constricted in order to increase the velocity and better direct air flowing out of the ends 42A and 42B toward the downstream end 14B of the blooie line 14. The proximal terminal ends 42A and 42B of the connectors 16A and 16B preferably do not extend beyond the shield pipe 40 so that they are protected from abrasive materials by the shield pipe 40.

The blowdown line 20 also is provided at the enlarged end 28B of the chamber 24 and is shielded from abrasion by the shield pipe 40. The blowdown line 20 is preferably located between the connectors 16A and 16B and approximately 90 degrees from each of the connectors 16A and 16B and also above the shield pipe 40 so that it does not accidentally become plugged with debris that might accumulate at the bottom of the surge device 10.

The upstream end 14U of the blooie line 14 connects to the well 12 via a rotating head 36. Thus the chamber 24 of the surge device 10 is in communication with the well 12 and can, via the blow down line 20 provided on the surge device 10, be used to bleed pressure off of the well 12 prior to breaking drill pipe 38 to make a connection. Also, the chamber 24 can, via surge connectors 16A and 16B that attach to surge lines 18A and 18B, be used to pull supply large volumes of air into the downstream end 14D of blooie line 14, thereby pulling a vacuum on the well 12 to safely remove flammable gases from the well 12 when workmen are engaged in making up a connection.

The second flange 26B is attached to a shield pipe 40 that penetrates the enlarged end 28B of the tapered chamber 24 and extends into the tapered chamber 24 a sufficient distance to serve as a shield against abrasion for the proximal terminal ends 42A and 42B of both the surge connectors 16A and 16B which penetrate through and extend into the tapered chamber 24 at the enlarged end 28B and the blow down line 20 which attaches to the tapered chamber 24 at the enlarged end 28B.

The shield pipe 40 is preferably constructed of abrasion resistant material as are the walls 22 of the surge device 10. Abrasive material and any entrained flammable gases that originate in the well 12 pass through the surge device 10 from the upstream end 14U of the blooie line 14 by first entering the second flange 26B, then traveling through the shield pipe 40 that is attached to the second flange 26B until the shield pipe 40 ends within the tapered chamber 24, next traveling through the tapered chamber 24 to its narrow end 28A, and finally traveling out of the surge device 10 via the first flange 26A to enter the downstream end 14D of the blooie line 14. From the downstream end 14D of the blooie line 14, abrasive material and entrained flammable gases are carried to the reserve pit by air that is introduced into the surge device 10 via surge lines 18A and 18B.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A surge device for air drilling a well comprising:

a tapered, hollow container, said container provided with a first flange on a narrow end of the container and provided with a second flange on an enlarged end of the container for removably attaching the container in-line in a blooie line of a well, each of said flanges communicating through a wall of the container, a blowdown line attached on the enlarged end of the container and communicating through the wall of the container, at least one surge connector attached on the enlarged end of the container and extending into the hollow container, and a shield pipe attached to the second flange and extending into the hollow container a sufficient distance to shield the blowdown line and surge connectors from abrasion.

2. A surge device according to claim 1 wherein said walls of the container and said shield pipe are constructed of abrasion resistant materials.

3. A surge device according to claim 2 further comprising:

two surge connectors attached on the enlarged end of the container so that the surge connectors are located on opposite sides of the shield pipe, and said blowdown line located above the shield pipe.

4. A surge device according to claim 2 further comprising:

a terminal end of each surge connector located within the container and pointed toward a flange opening provided in the first flange, and each said terminal end being constricted to increase the velocity of and better direct air flowing therethrough.

5. A combination surge device and blooie line for air drilling a well comprising:

a tapered, hollow container removably secured into a blooie line so that there is communication between the container and the blooie line, a blowdown line attached on an enlarged end of the container and communicating through a wall of the container, at least one surge connector attached on the enlarged end of the container and extending into the hollow container, and a shield pipe attached to the blooie line at the enlarged end of the container and extending into the hollow container a sufficient distance to shield the blowdown line and surge connectors from abrasion.

6. A surge device according to claim 5 wherein said walls of the container and said shield pipe are constructed of abrasion resistant materials.

7. A surge device according to claim 6 further comprising:

two surge connectors attached on the enlarged end of the container so that the surge connectors are located on opposite sides of the shield pipe, and said blowdown line located above the shield pipe.

8. A surge device according to claim 6 further comprising:

a terminal end of each surge connector located within the container and pointed toward a downstream end of the blooie line, and each said terminal end being constricted to increase the velocity of and better direct air flowing from the terminal end to the downstream end of the blooie line.

* * * * *